US006296536B1

(12) United States Patent
Katayama et al.

(10) Patent No.: US 6,296,536 B1
(45) Date of Patent: Oct. 2, 2001

(54) COWLING ASSEMBLY FOR OUTBOARD MOTOR

(75) Inventors: Goichi Katayama; Takaji Kawai; Masanori Takahashi; Hitoshi Ishida, all of Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/559,863

(22) Filed: Apr. 27, 2000

(30) Foreign Application Priority Data

Apr. 27, 1999 (JP) ..... 11-119573
Apr. 27, 1999 (JP) ..... 11-119575

(51) Int. Cl.[7] ..... B63H 20/32
(52) U.S. Cl. ..... 440/77; 440/88
(58) Field of Search ..... 440/77, 88

(56) References Cited

U.S. PATENT DOCUMENTS

| | | | |
|---|---|---|---|
| 4,571,193 | 2/1986 | Takada et al. | 440/77 |
| 4,952,180 | 8/1990 | Watanabe et al. | 440/77 |
| 4,968,276 | 11/1990 | Hashimoto | 440/77 |
| 5,181,870 | 1/1993 | Arai et al. | 440/77 |
| 5,340,343 | 8/1994 | Kawamukai et al. | 440/88 |
| 5,873,755 | 2/1999 | Takahashi et al. | 440/77 |
| 5,928,043 * | 7/1999 | Rinzaki | 440/77 |

FOREIGN PATENT DOCUMENTS

| | | | |
|---|---|---|---|
| 60161187 * | 1/1994 | (JP) | 440/88 |

* cited by examiner

*Primary Examiner*—Jesus D. Sotelo
(74) *Attorney, Agent, or Firm*—Knobbe, Martens, Olson & Bear, LLP

(57) ABSTRACT

A cowling assembly for an outboard motor includes an improved construction that can supply relatively cool air containing little if no water to the induction device and that can also supply air to cool engine components without reducing the charging efficiency. The outboard motor has an engine that includes an air induction device and is enclosed by the cowling. The induction device has an air inlet opening. The cowling assembly defines a closed cavity in which the engine is contained and has an air intake duct that introduces air into the cavity. The intake duct adjoins the inlet opening and has an opening opened to the cavity and positioned lower than a lower end of the inlet opening. In one form, the cowling assembly has at least one front air intake opening formed on a side surface of its front portion. A rear air intake opening is also formed on a rear surface of its rear end portion. The cowling front air opening primarily supplies air to the induction system, while the cowling rear air opening primarily supplies a cooling air flow across the engine.

37 Claims, 12 Drawing Sheets

COWLING ASSEMBLY FOR OUTBOARD MOTOR

PRIORITY INFORMATION

This application is based on and claims priority to Japanese Patent Application Nos. Hei 11-119573, filed Apr. 27, 1999, and Hei 11-119575, filed Apr. 27, 1999, the entire contents of which are hereby expressly incorporated by reference.

BACKGROUND OF THE INVENTION

1. Field of the Invention

This invention relates to a cowling for an outboard motor, and more particularly to an air intake construction of the cowling.

2. Description of Related Art

A typical outboard motor employs an internal combustion engine for powering a propulsion device such as a propeller. A protective cowling normally encloses the engine therein to present a neat appearance but also to protect the engine. The cowling protects the engine from being wetted by the water in which the outboard motor is operated. Water, especially salt water, tends to damage engine components.

The protective cowling defines a generally closed cavity in which the engine is contained. The engine, however, must be supplied with copious amounts of air through an air induction device for combustion in its combustion chambers. For this purpose, the air induction system of the engine has an air inlet opening that is open to the cavity within the cowling. Conventionally, the protective cowling includes a rearwardly positioned, generally upwardly facing air intake duct that permits air flow into the cavity. The intake duct usually extends in an additional small cavity, which defines an air compartment. Air flow through the duct often is normal to the direction of air flow into the air compartment to cause water to drop out of the air flow before the air moves through the duct. This arrangement thus inhibits water from entering the main cavity of the cowling; however, it does not entirely prevent water from entering the cavity through the duct.

The air inlet opening of the engine induction system is normally positioned at a front portion of the cavity. Thus, the air must travel across the engine body from the air duct to the air inlet opening. This air flow advantageously cools various engine components, but it is also warmed through this process, which reduces charging efficiency. This problem is exacerbated with outboard motors employing four-stroke engines at these engines tend to run hotter than two-stroke engines.

SUMMARY OF THE INVENTION

The present invention involves the recognition of a need for an improved cowling that can supply relatively cool air containing little or no water to the induction device. It is appreciated, however, that the solution involves more than simply placing the intake duct in the vicinity of the induction system inlet open because the exclusion of water from the inlet air charge is a formidable challenge with such an arrangement. In addition, the improved cowling construction also preferably provides an air flow across the engine to cool various engine components without reducing the charging efficiency.

One aspect of the prevent invention thus involves an improved cowling assembly for an outboard motor. The outboard motor has an internal combustion engine including an air induction device. The air induction device includes an air inlet opening. The cowling assembly comprises a cowling member defining a generally closed cavity that contains the engine. An air intake duct introduces ambient air into the cavity. The air intake duct adjoins the air inlet opening. The intake duct has an opening that is opened to the cavity and positioned generally lower than a lower end of the air inlet opening.

In accordance with another aspect of the present invention, a cowling assembly has at least one front air intake opening formed on a side surface of its front portion and a rear air intake opening formed on a rear surface of a rear end portion.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

DETAILED DESCRIPTION OF THE PREFERRED EMBODIMENTS OF THE INVENTION

Figure 1:
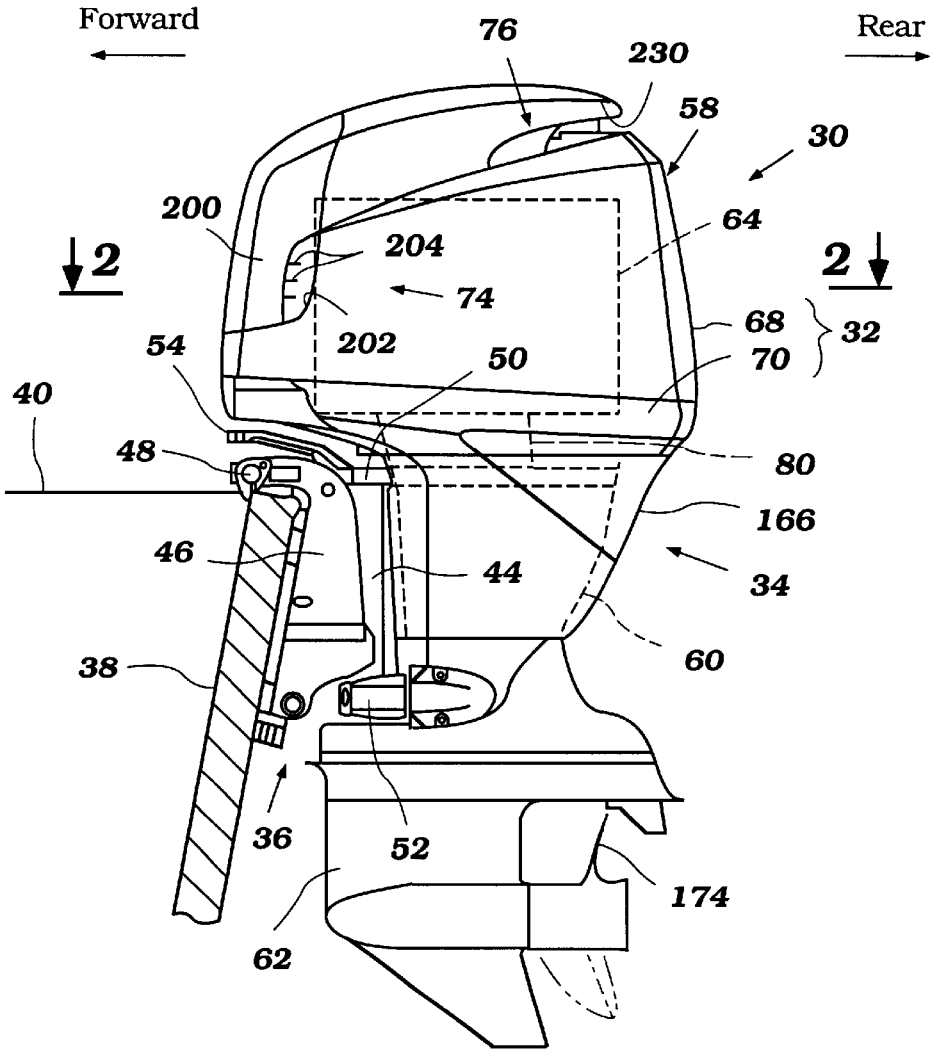
FIG. 1(A) is a side elevational view of an outboard motor employing a power head that includes a protective cowling assembly constructed in accordance with a preferred embodiment of the present invention.
FIG. 1(B) is a top plan view of the cowling assembly.
Figure 1:
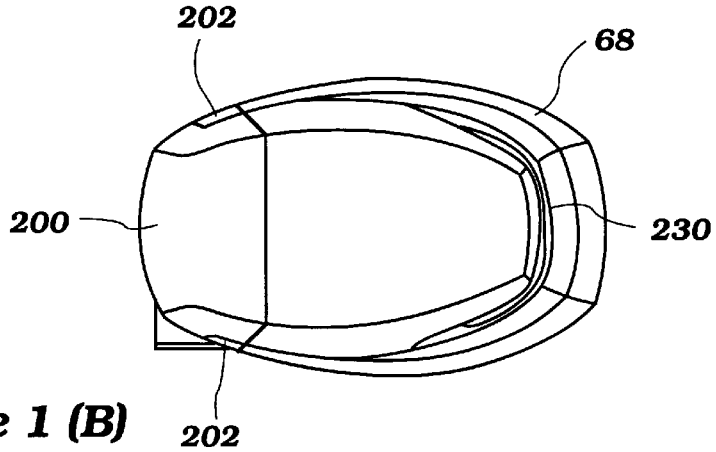

With initial reference to FIGS. 1(A) to 8, an outboard motor 30 incorporates a protective cowling assembly 32 configured in accordance with a preferred embodiment of the present invention.

In the illustrated embodiment, the outboard motor 30 comprises a drive unit 34 and a bracket assembly 36. The bracket assembly 36 supports the drive unit 34 on a transom 38 of an associated watercraft 40 so as to place a marine propulsion device in a submerged position with the watercraft 40 resting on the surface of a body of water. The bracket assembly 36 comprises a swivel bracket 44, a clamping bracket 46, a steering shaft and a pivot pin 48.

The steering shaft extends through the swivel bracket 44 and is affixed to the drive unit 34 with an upper mount assembly 50 and a lower mount assembly 52. The steering shaft is pivotally journaled for steering movement about a generally vertically extending steering axis within the swivel bracket 44. A steering handle 54 extends upwardly and forwardly from the steering shaft to steer the drive unit 34. The clamping bracket 46 includes a pair of bracket arms spaced apart from each other and affixed to the watercraft transom 38. The pivot pin 48 completes a hinge coupling between the swivel bracket 44 and the clamping bracket 46. The pivot pin 48 extends through the bracket arms so that the clamping bracket 46 supports the swivel bracket 38 for pivotal movement about a generally horizontally extending tilt axis of the pivot pin 48.

As used through this description, the terms "front," forward" and "forwardly" mean at or to the side where the clamping bracket 46 is located, and the terms "rear," "reverse" and "rearwardly" mean at or to the opposite side of the front side, unless indicated otherwise.

Although not shown, a hydraulic tilt system is provided between the swivel bracket 44 and clamping bracket 46 to tilt up and down and also for the trim adjustment of the drive unit 34. Since the construction of the bracket assembly 36 is well known in the art, further description is not believed to be necessary to permit those skilled in the art to practice the invention.

The drive unit 34 includes a power head 58, a driveshaft housing 60 and a lower unit 62. The power head 58 is disposed atop of the drive unit 34 and includes an internal combustion engine 64 and the protective cowling assembly 32. The protective cowling assembly 32 includes a top cowling 68 and a bottom cowling 70 both generally made of synthetic resin.

The cowling assembly 32 generally completely encloses the engine 64. That is, the cowling assembly 32 defines a generally closed cavity 71 to contain the engine 64 therein. The top cowling 68 is detachably affixed to the bottom cowling 70 with a conventional coupling mechanism 72 (see FIGS. 3 and 4) so that the operator can access the engine 64 for maintenance or for other purposes. The top cowling 68 preferably includes a front air intake construction 74 and a rear air intake construction 76 both introducing ambient air into the cavity 71. The front and rear air intake constructions 74, 76 will be described in detail later. In another variation, the top cowling 68 can include one or the other of the front and rear air intakes 74, 76; however, both are preferred.

The bottom cowling 70 has an opening at its bottom portion through which an exhaust guide 80 extends. The exhaust guide 80 is affixed atop of the driveshaft housing 60. The bottom cowling 70 and the exhaust guide 80, thus, generally form a tray. The engine 64 is placed onto this tray and is affixed to the exhaust guide 80 to be supported thereby. The exhaust guide 80 also has an exhaust passage therein, through which a burnt charge (e.g., exhaust gases) is discharged.

In the illustrated embodiment, the engine 64 operates on a four-stroke combustion principle and powers a propulsion device (e.g., a propeller). The engine 64 has a cylinder body 82. Although not shown, the cylinder body 82 defines a plurality of cylinder bores that extend generally horizontally and are stacked and spaced generally vertically above one other. In the illustrated embodiment, the engine 64 is a L4 (in-line four cylinder) type. This type of engine, however, is merely exemplary of a type with which various aspects and features of the present cowling assembly and outboard motor can be used. Engines having other number of cylinders, having other cylinder arrangements, and operating on other combustion principles (e.g., crankcase compression two-stroke or rotary) are all practicable with the present outboard motor and cowling assembly.

A piston reciprocate in each cylinder bore. A cylinder head member 84 is affixed to one end of the cylinder body 82 and a cylinder head cover member 86 is affixed to cover the cylinder head member 84. The cylinder head member 84 and cylinder head cover member 86 together form a cylinder head assembly 88.

The other end of the cylinder body 82 is closed with a crankcase member 90 that defines a crankcase chamber with the cylinder body. A crankshaft 92 extends generally vertically through the crankcase chamber. The crankshaft 92 is pivotally connected to the pistons and rotates with the reciprocal movement of the pistons. Each piston has at least one piston ring on its periphery to isolate the combustion chamber from the crankcase chamber.

Figure 2:
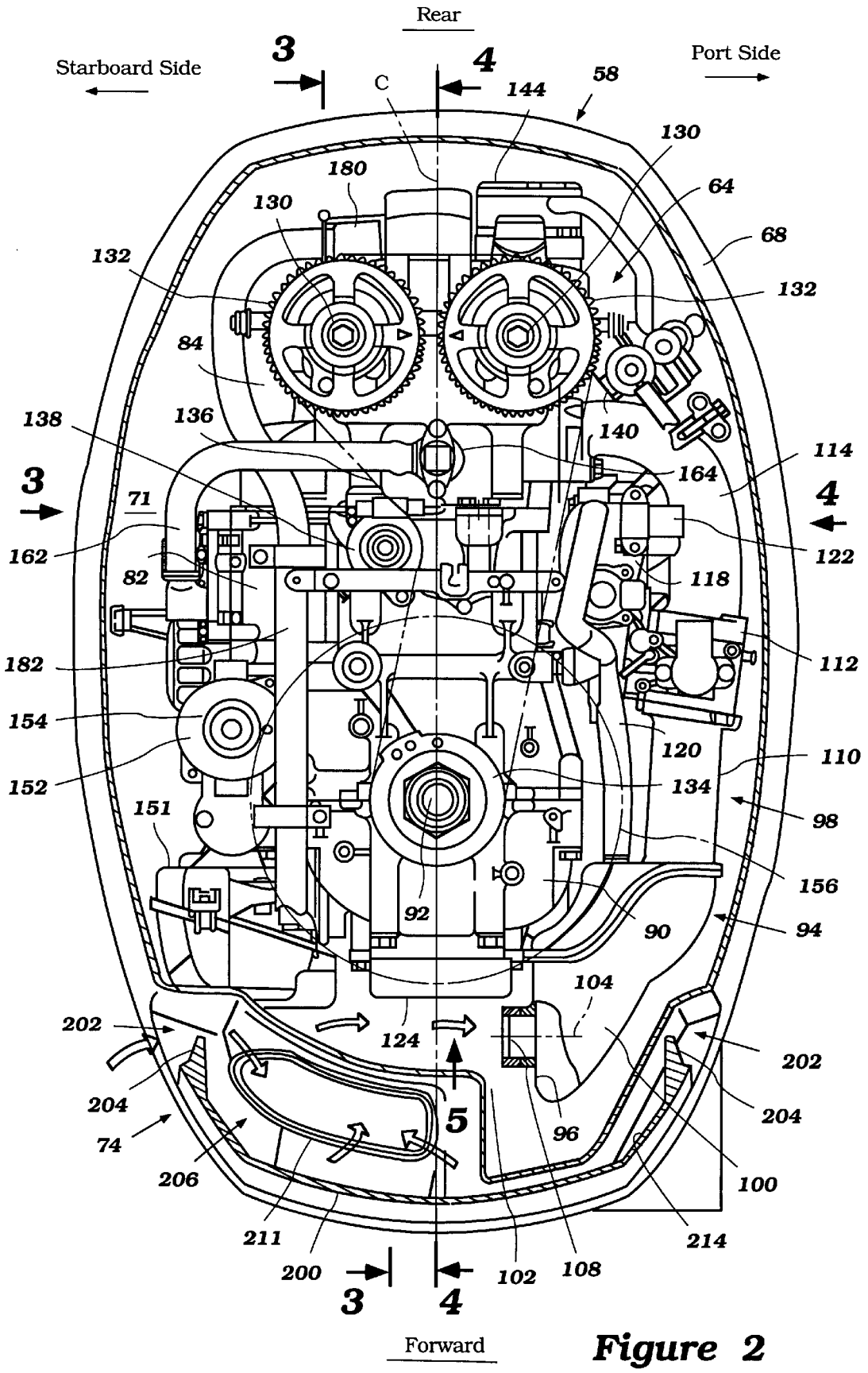
FIG. 2 is a top plan view showing the power head of the motor. The cowling assembly is sectioned along the line 2—2 of FIG. 1 to reveal the engine contained within the cowling assembly. A plenum chamber member is also partially sectioned and a blow-by gas conduit is partially omitted.
Figure 5:
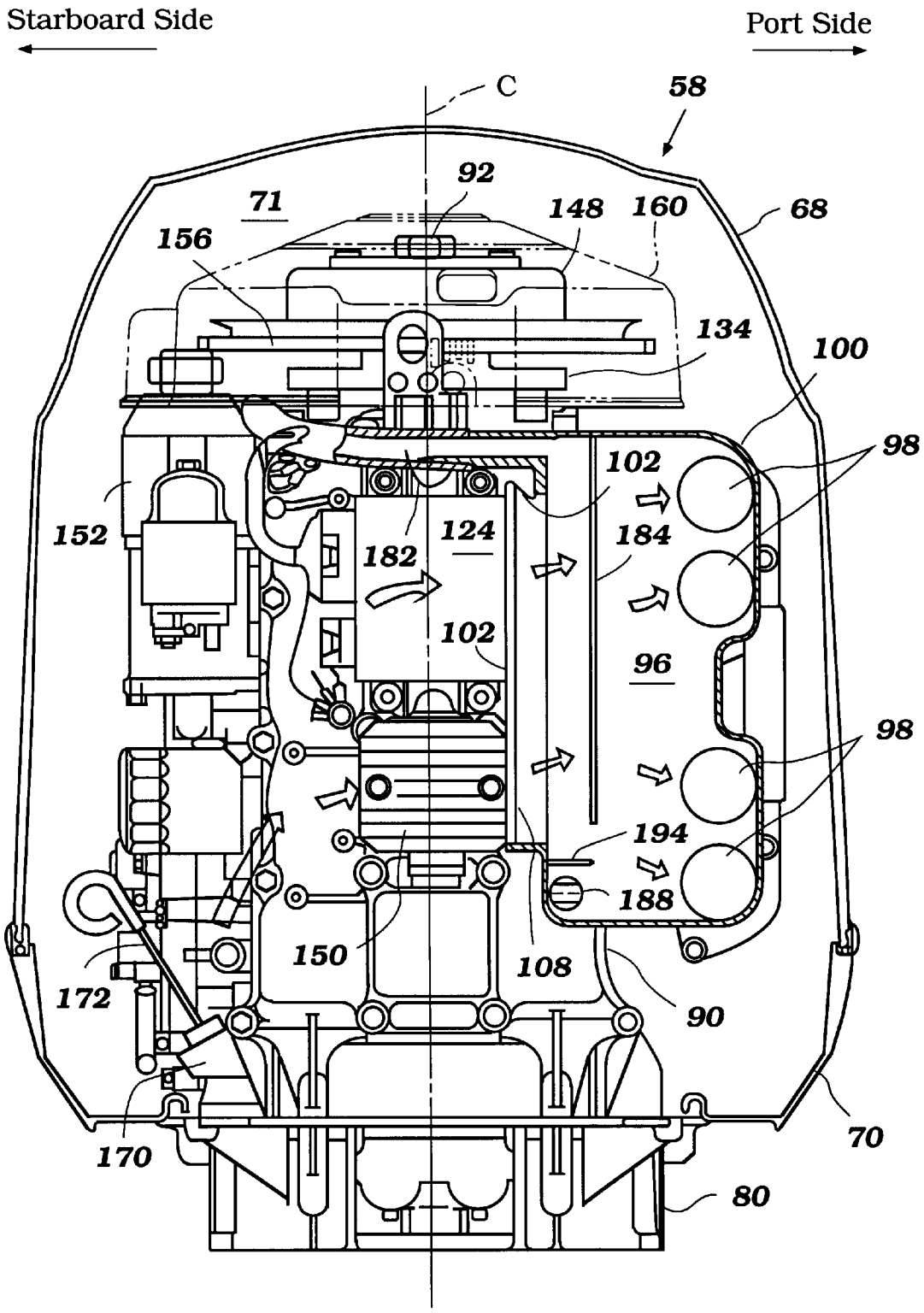
FIG. 5 is a front elevational view of the power head looking in the direction of Arrow 5 of FIG. 2. The cowling assembly and the plenum chamber member are sectioned and an outer blow-by gas conduit also is partially sectioned. The plenum chamber member and outer blow-by gas conduit are somewhat schematically indicated. In addition, although indicated with an actual line, an intake air temperature sensor is positioned behind the section line (i.e., on a front side of the plenum chamber member).

The crankcase member 90 is located at the most forward position, then the cylinder body 82 and the cylinder head assembly 88 extend rearwardly from the crankcase member 90 one after another. As seen in FIGS. 2 and 5, a center plane C, which includes an axis of the crankshaft 92 and the axes of the cylinders, bifurcates the engine body components 82, 88, 90 and the cavity 71.

The engine 64 includes an air induction system 94 and an exhaust system. The air induction system 94 is arranged to supply air charges to the combustion chambers and comprises a plenum chamber 96, main air delivery conduits 98 and intake ports. The intake ports are defined in the cylinder head assembly 88 and opened or closed by intake valves. When the intake ports are opened, the air delivery conduits 98 communicate with the combustion chambers.

Figure 3:
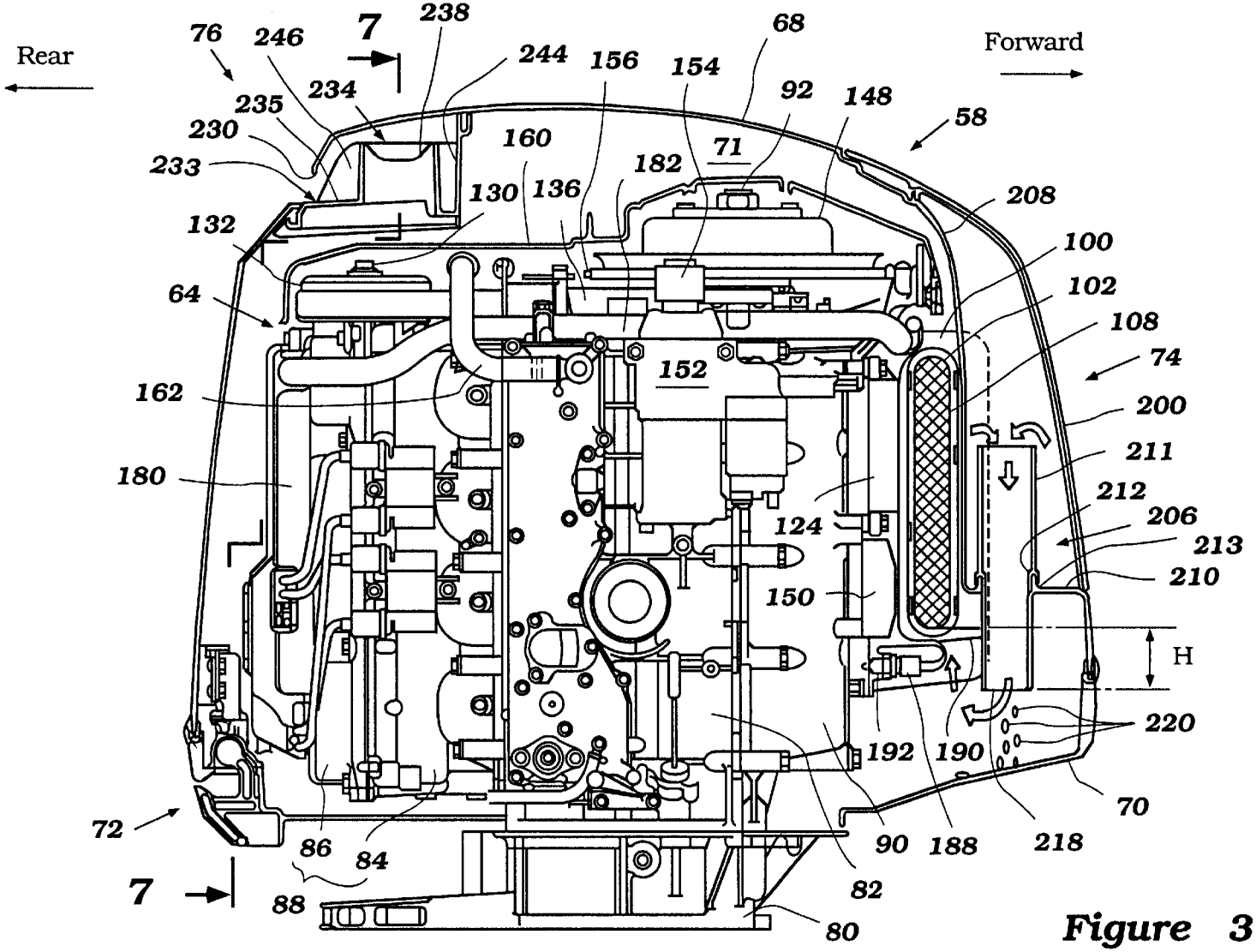
FIG. 3 is a side elevational view of the power head looking in the direction of Arrow 3 of FIG. 2 to show the starboard side construction of the engine. The cowling assembly is sectioned along the line 3—3 of FIGS. 2 and 7; however, the engine is not sectioned.
Figure 4:
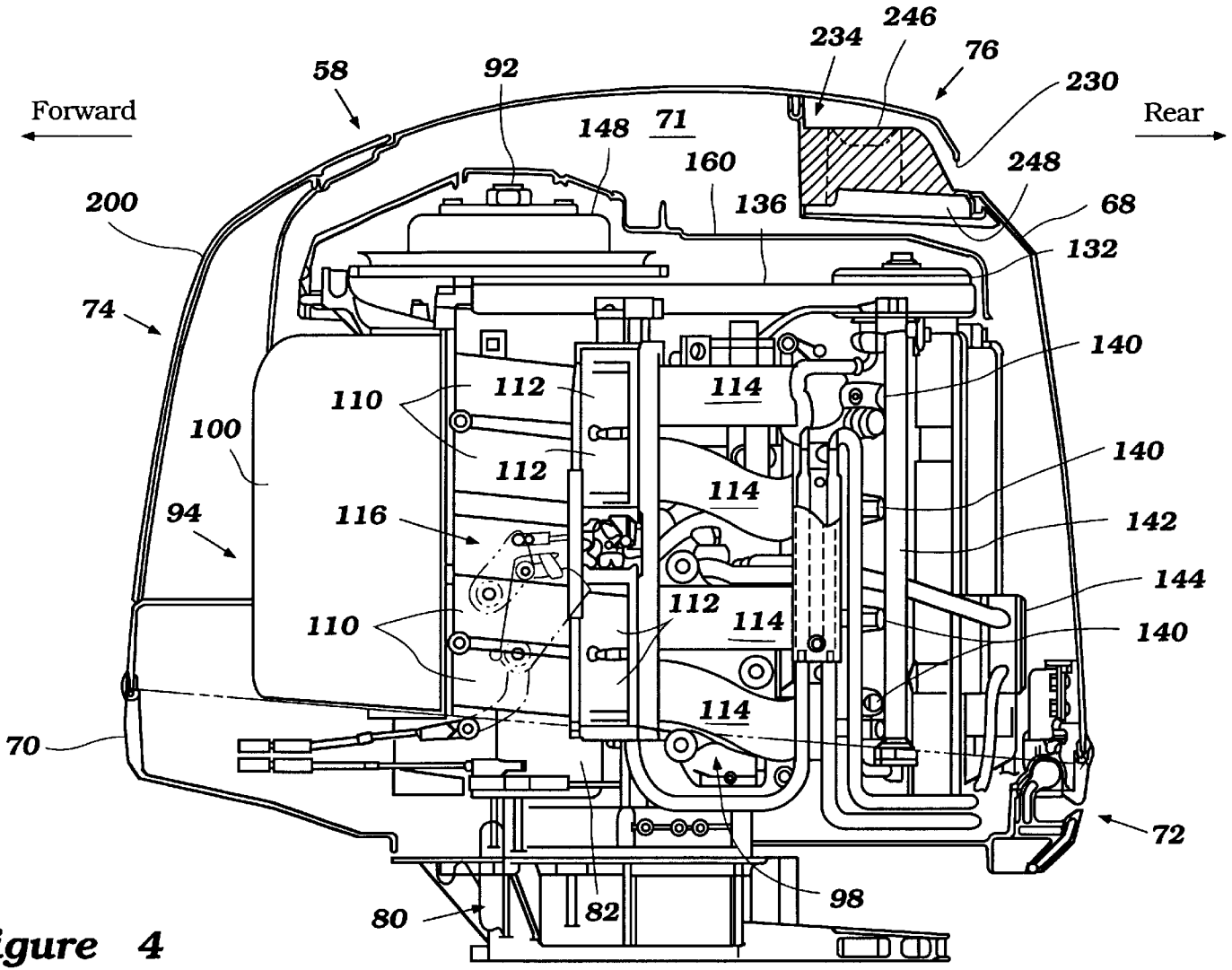
FIG. 4 is a side elevational view of the power bead looking in the direction of Arrow 4 of FIG. 2 to show the port side construction of the engine. The cowling assembly is sectioned along the line 4—4 of FIGS. 2 and 7; the engine, however is not sectioned.

The plenum chamber 96 functions as an intake silencer and as a coordinator of air charges. In the illustrated embodiment, the plenum chamber 96 is defined in a plenum chamber member 100 positioned on the port side of the crankcase member 90. The air delivery conduits 98 extend rearwardly from the plenum chamber member 100 along a flank of the cylinder body 82 on the port side and then bend toward the intake ports. The plenum chamber member 100 is generally molded of a synthetic resin or cast and formed as a rectangular box, as seen in FIGS. 3 to 5, in the side and rear views so that air can be introduced to the delivery conduits 98 evenly from the plenum chamber 96. The plenum chamber member 100 is affixed to the crankcase member 90.

The plenum chamber member 100 has an air inlet opening 102 that is formed as a vertically extending ellipse. The inlet opening 102 projects into the cavity 71 so as to open thereto and faces to the other or opposite half part of the cavity 71. The axis 104 of the air inlet opening 102 extends generally normal to the center plane C. A filter 108 is provided to cover the air inlet opening 102. In the illustrated embodiment, the filter 108 is a fine metal or meshed metal formed by a plurality of crossing wires. Thus, the filter 108 primarily inhibits objects from entering the plenum chamber 96 and further arrests any backfire flames from the combustion chamber.

An inner construction of the plenum chamber member 100 and a relationship in position of the chamber member 100 with the front air intake construction 74 will be described later.

The air delivery conduits 98 are actually defined by delivery ducts 110, throttle bodies 112 and runners 114. As best seen in FIG. 4, the upper, two throttle bodies 112 are unified with each other, while the lower, two throttle bodies 112 are also unified with each other. Both throttle body units are further assembled and affixed to the cylinder body 82. The top runner 114 and the third runner 114 from the top extends generally horizontally. However, the second and fourth runners 114 are slightly downwardly curved downstream thereof to meet the respective intake ports. As best seen in FIG. 5, the respective delivery conduits 98 are generally spaced apart vertically so as to extend side by side with each other.

The respective throttle bodies 112 preferably support butterfly-type throttle valves therein for pivotal movement about axes of valve shafts extending generally vertically; however, other types of throttling devices also can be used to regulate air flow into the combustion chambers. The valve shafts are linked together to form a single valve shaft that passes through the entire assembly of throttle bodies 112. The throttle valves are operable by the operator through a suitable throttle cable and a linkage mechanism 116.

When the operator operates the throttle cable, the linkage mechanism 116 activates the valve shaft to open the throttle valves. Conversely, when the throttle cable is released, the linkage mechanism 116 activates the valve shaft to close the throttle valves.

The air induction system 94 further includes an idle air supply unit 118. The idle air supply unit 118 bypasses the throttle valves. An upstream bypass conduit 120 couples the unit 118 together with the plenum chamber member 100, while a downstream bypass conduit 122 couples the unit 118 with one of the delivery conduits 98. The idle air supply unit 118 contains a valve member pivotally disposed therein. When the throttle valves in the throttle bodies 112 are almost closed at idle, the valve member in the idle air supply unit 118 is operated to supply necessary air to the combustion chambers under control of an ECU (Engine Control Unit). The ECU is electrically operable and contained in an ECU box 124 (see FIG. 5) that is mounted on a front surface of the crankcase member 90 in a known manner.

The exhaust system is arranged to discharge burnt charges or exhaust gases outside of the outboard motor 30 from the combustion chambers. Exhaust ports are defined in the cylinder head assembly 88 and opened or closed by exhaust valves. When the exhaust ports are opened, the combustion chambers communicate with exhaust passages which route the exhaust gases downstream through the exhaust system.

As seen in FIG. 2, two camshafts 130, which are disposed within the cylinder head assembly, extend generally vertically to activate the intake valves and exhaust valves. The camshafts 130 have cam lobes thereon to push the intake and exhaust valves at certain timings to open or close the respective ports. The camshafts 130 are journaled on the cylinder head member 84 and are driven by the crankshaft 92. The respective camshafts 130 have sprockets 132 thereon, while the crankshaft 92 also has a sprocket 134 thereon. A timing belt or chain 136 is wound around the sprockets 132, 134. With rotation of the crankshaft 92, the camshafts 92 also rotate. A tensioner 138 is provided to adjust the tension of the belt or chain 136 by pushing it inwardly so as to keep the opening and closing timing of the intake and exhaust valves accurate. The tensioner 138 includes, for example, a gas cylinder containing compressed gases therein to produce the tensioning force.

In the illustrated embodiment, the engine 64 has a fuel injection system, although any other conventional fuel supply systems can be applied. The fuel injection system includes four fuel injectors 140 which have injection nozzles directed toward the intake ports. The fuel injectors 140 are supported by a fuel rail 142 that is affixed to the cylinder head assembly 88.

The fuel injection system further includes a vapor separator, a first low pressure fuel pump or manual pump, a second low pressure fuel pump 144, a high pressure fuel pump, a pressure regulator, a fuel supply tank, a fuel filter 146 and several fuel conduits connecting those components. The fuel supply tank and manual pump are disposed on a hull of the watercraft 40 and the other components are placed on the outboard motor 30. An amount of each fuel injection and injection timing are controlled by the ECU. The fuel injection system is well known in the art and no further description is believed necessary to practice the present invention.

The engine 64 further has a firing system. Four spark plugs are exposed into the respective combustion chambers and fire an air/fuel charge at a proper timing. This firing timing is also controlled by the ECU. The air/fuel charge is formed with an air charge supplied by the main air delivery conduits 98 or idle air supply unit 118 and a fuel charge sprayed by the fuel injectors 140. The burnt charge, as described above, is discharged outside through the exhaust system.

A flywheel assembly 148 is affixed atop the crankshaft 92. The flywheel assembly 148 includes a generator to supply electric power to the firing system, to the ECU and to other electrical equipment via a battery and/or directly. The electrical equipment includes a power source box 150 mounted on the front surface of the crankcase member 90 directly below the ECU box 124 and a relay box 151 mounted on a starboard side surface thereof.

A starter motor 152 is mounted on the cylinder body 82 in the vicinity of the flywheel assembly 148. A gear 154 of the starter motor 152 is meshed with a ring gear 156 provided on a periphery of the flywheel assembly 148 through a one-way clutch. The starter motor 152 rotates the crankshaft 92 via the flywheel assembly 148 when the operator operates a main switch. However, since the starter gear 154 and the ring gear 156 are coupled together by the one-way clutch, the crankshaft 92 cannot rotate the starter motor 152 immediately after starting of the engine 64.

A protector 160 covers the flywheel assembly 148, starter motor 152, sprockets 132, 134 and the belt 136 for protection of the operator from such moving parts.

The engine 64 has a cooling system that provides coolant to engine portions and also to exhaust passages in the driveshaft housing 60 because they generate significant heat during engine operations. The heat accumulates therein and may deteriorate the engine operations unless they are properly cooled down. In the illustrated embodiment, water is used as the coolant and is introduced from the body of water surrounding the outboard motor 30 as will be described later.

The water introduced into the cooling system is delivered to the portions which require cooling (e.g., the cylinder body). After cooling such components, the water is discharged outside through a discharge conduit 162 and a discharge jacket formed in the cylinder body 82. A thermostat 164 is provided at the most upstream portion of the discharge conduit 162. If the temperature of the water is lower than a preset temperature, the thermostat 164 will not allow the water to flow out to the discharge conduit 162 so that the engine 64 can warm up itself properly.

The air introduced into the cavity 71 through the front air intake construction 74 and is the rear air intake construction 76 may take the heat in the engine components and other heat accumulating in the electrical equipment that cannot be taken by the cooling water. This cooling process will be described shortly.

With reference back to FIG. 1(A), the driveshaft housing 60 depends from the power head 58 and supports a driveshaft which is driven by the crankshaft 92 of the engine 64. The driveshaft extends generally vertically through the exhaust guide 80 and then driveshaft housing 60. The driveshaft housing 60 also defines internal passages which form portions of the exhaust system. In the illustrated embodiment, an apron 166 covers an upper portion of the driveshaft housing 60.

The engine 64 has also a lubrication system. A lubricant reservoir depends from the exhaust guide 80 within the driveshaft housing 60. A lubricant pump is driven by the driveshaft to supply lubricant to engine components that need lubrication. The lubricant then drains to the lubricant reservoir.

The engine components that need lubrication include the pistons that furiously reciprocate within the cylinder bores. The pistons need the lubrication not to seize on surfaces of the cylinder bores. The aforenoted piston rings can remove the oil from the surfaces of the cylinder bores and carry out to the crankcase chambers.

The lubricant reservoir includes an oil inlet 170 and an oil gauge 172. The oil gauge 172 is employed for checking quality and quantity of the lubricant in the reservoir. The oil gauge 172 is usually used for plugging up the oil inlet 170 and taken out from the inlet 170 only when checking the lubricant.

The lower unit 62 depends from the driveshaft housing 60 and supports a propulsion shaft which is driven by the driveshaft The propulsion shaft extends generally horizontally through the lower unit 62 when the outboard motor is in a fully tilted down position. In the illustrated embodiment, the propulsion device includes a propeller 174 that is affixed to an outer end of the propulsion shaft and is driven by the propeller shaft. The propulsion device, however, can take the form of a dual, counter-rotating propeller system, a hydrodynamic jet, or the like propulsion device.

A transmission is provided between the driveshaft and the propeller shaft. The transmission couples together the two shafts which lie generally normal to each other (i.e., at a 90° shaft angle) with a bevel gear train or the like.

The transmission has a switchover or clutch mechanism to shift rotational directions of the propeller 174 to forward, neutral or reverse. The switchover mechanism is operable by the operator through a shift linkage including a shift cam, a shift rod and a shift cable.

The lower unit 62 also defines an internal passage that forms a discharge section of the exhaust system. At engine speed above idle, the majority of the exhaust gases are discharged to the body of water surrounding the outboard motor 30 through the internal passage and finally through a hub of the propeller 174, as well known in the art.

Additionally, the driveshaft housing 60 has a water pump that is driven by the driveshaft and supplies cooling water to the aforenoted cooling system. Water is introduced through a water inlet (not shown) which opens at the lower unit 62. The water inlet is connected to the water pump through an inlet passage, while the water pump is connected to the respective portions that need the cooling water through a supply passage. The supply passage, then, diverges to a plurality of water passages and jackets in the engine 64.

In the illustrated embodiment, the engine 64 further includes a blow-by gas ventilation system. Although the combustion chambers are isolated from the crankcase chambers by the piston rings, actually some of the combustion gases and unburned charges can go into the crankcase chamber. These gases and charges, i.e., blow-by gases, must be removed from the crankcase chamber. The ventilation system is provided in order to remove the blow-by gases.

The ventilation system principally comprises an inner blow-by gas conduit, an oil separator or breather 180 and an outer blow-by gas conduit 182. The inner conduit is formed internally between the crankcase member 90, cylinder body 82 and cylinder head assembly 88 and connects the crankcase chamber to an uppermost portion of the oil separator 180. The oil separator 180 is mounted on the cylinder head assembly 88 and can be integrally or unitarily formed, at least in part, with the assembly cylinder head assembly 88. The oil separator 180 has a labyrinth structure therein to separate an oil component from the blow-by gases because the blow-by gases may contain a portion of the lubricant that has been used for the lubrication of the pistons. The outer blow-by gas conduit 182 couples an outer, uppermost portion of the oil separator 180 to the plenum chamber member 100. The outer conduit 182 extends forwardly from the separator 180 along generally upper portions of the cylinder head assembly 88, cylinder body 82 and crankcase is member 90 on the starboard side surface in the illustrated embodiment. That is, the outer conduit 182 lies on the opposite side of the air delivery conduits 98.

As seen in FIG. 5, the outer blow-by gas conduit 182 and the plenum chamber member 100 are coupled together. The coupling portion is positioned atop of the plenum chamber member 100. The plenum chamber member 100 has a baffle 184, which interrupts a flow of the blow-by gases, disposed in front of the coupling portion. The baffle 184 is uniformly molded with the plenum chamber member 100 and formed as a thin member or plate shape, although it can be separately provided from the plenum chamber member 100. The baffle 184 is formed as an inverted triangle from the top inner wall of the plenum chamber member 100. This is because the coupling portion is positioned atop of the plenum chamber member 100 while the respective air delivery conduits 98 are disposed side by side vertically.

Air in the plenum chamber 96 is drawn toward the combustion chambers by the evacuating force generated when the pistons move toward the crankcase during their intake strokes. If the baffle 184 is configured as a rectangular shape, the air will most likely enter the top delivery conduit 98. The higher the delivery conduit 98 is placed, the easier the blow-by gases enter the conduit 98 in this construction. However, the inverted triangle shape of the baffle improves uniform distribution of the blow-by gases among the respective delivery conduits 98. In other words, the blow-by gases can be evenly distributed to the respective delivery conduits 118 due to the inverted triangle configuration. The inverted triangle interrupts the flow of blow-by gases toward the delivery conduits 118, but this interruption decreases gradually toward the bottom of the plenum chamber.

As noted above, the ECU controls the engine operations including the fuel injection system. In order to determine appropriate control indexes in control maps, which are stored within and used by ECU, or to calculate them based upon the control indexes determined in the maps, various sensors are provided for sensing engine conditions and other environmental conditions in accordance with control strategies. The sensors may include, for example, a throttle valve position sensor, an intake air temperature sensor, an intake air pressure sensor, a water temperature sensor and a crankshaft angle position sensor.

In the illustrated embodiment, the ECU determines an amount of intake air based upon a throttle opening signal sensed by the throttle valve position sensor (not shown) and an intake air temperature signal sensed by the intake air temperature sensor 188 that is mounted on the plenum chamber member 100. Then, the ECU controls an amount of fuel injection in response to the determined intake air amount and an engine speed signal sensed by the crankshaft angle position sensor on a feed-back control principle so that an actual air/fuel ratio is consistent with or approaches to an aimed air/fuel ratio.

The plenum chamber member 100 has a recess 190 formed at a bottom thereof. The recess 190 is sunken inward and a large part of the temperature sensor 188 is positioned within the recess 190. Thereby, the part of the sensor 188 is well protected from being damaged even when the top cowling 68 is put on and taken off. The sensor 188 is affixed to a forward wall of the recess 190 of the chamber member 100 so that its sensor element 192 is positioned within the plenum chamber 100 because it is desirably to accurately determine the intake air amount and hence the sensor element 192 needs to sense the air temperature in the plenum chamber 96.

As seen in FIG. 5, the sensor element 192 of the temperature sensor 188 is disposed generally below a portion of the plenum chamber member 100 from which the coupling portion of the blow-by gas conduit 182 extends. Also, the sensor element 192 is positioned below and in a vicinity of a bottom end of the baffle 184. Although almost of the oil component has been removed from the blow-by gases before entering the plenum chamber 96, a very small amount of the oil component still remains and may drop onto the sensor element 192. If the oil component deposits on the sensor element 192 and adheres thereto, the detection characteristic of the intake air temperature sensor 188 may decline and the ECU cannot accurately control the air/fuel ratio.

In order to protect the sensor element 192 and preclude the oil component from adhering thereto, a cover portion 194 extends between the opening where the blow-by gases enter and the sensor element 192. In the illustrated embodiment, the cover portion 192 protrudes above the sensor element 192 like a visor from the inner wall of the chamber member 100. Although the cover portion 194 is unitarily molded with the chamber member 100, it can be separately formed and be affixed to the chamber member 100. As seen in FIG. 5, the cover portion 194 is provided lower than the air inlet 124 not to interrupt the air flow.

As noted above, the top cowling 68 has the front and rear air intake constructions 74, 76. Still with reference to FIGS. 1(A) to 5, the front air intake construction 74 and its relationship in position with the plenum chamber member 100 will now be described.

In the illustrated embodiment, as best seen in FIG. 1(B), the top cowling 68 has a single front cover or shell member 200 which is separately provided from the top cowling 68 and is detachably affixed to the cowling 68 by press fitting or by screws or an adhesive. Front air intake openings 202 are formed on both sides of the power head 58, and between the top cowling 68 and the front cover 200. The intake openings 202 may be formed only with and on the front cover 200 instead of being formed between the top cowling 68 and the front cover 200. The front cover 200, as well as the top cowling 68, preferably are made of synthetic resin and the front cover 200 has a plurality of projections 204 formed uniformly with the cover 200, as best seen in FIG. 1(A). The projections 204 extend rearwardly from the cover body not only to prevent objects, such as a small bird, from entering the air intake construction 74, but also to enhance the external appearance of the outboard motor 30.

As best seen in FIG. 3, a front end of the top cowling 68 is recessed to define a front air compartment or cavity 206 with the front cover 200. More specifically, the front end of the top cowling 68 has a recessed portion generally formed with vertically extending section 208 and a generally horizontally extending bottom section 210. The bottom section 210 has a through-hole that holds a front air intake duct 211 that also is preferably made of synthetic resin. The intake ducts 211 lies adjacent to the air inlet opening 102 and in the illustrated preferred embodiment, extends generally parallelly to the inlet opening 102 of the induction system.

The intake duct 211 has a coupling flange 212 circularly formed on a middle part of the duct 211. The coupling flange 212 is engaged with a receiving flange 213 that extends upwardly from the bottom section 210 so as to complete affixing of the intake duct 211 to the bottom section 210. An upper portion of the intake duct 211, which lies higher than the coupling flange 212, extends in the air compartment 206 with a certain length, while a lower portion thereof extends in the interior of the cowling assembly 66 also with a certain length.

With the structure, the air compartment 206 communicates with the cavity 71 through the intake duct 211. Ambient air, therefore, can first enter the air compartment 206 through the front air intake openings 202 and then goes down to the interior of the cowling assembly 32, i.e., the cavity 71, through the intake duct 211. That is, the air compartment 206 acts as a baffle space. Water or moisture entering the compartment 206 with the ambient air impinges the vertical wall section 208 or the external surface of the duct 211. Most of the water thus is separated from the air and flows down along the wall section 208 or the external surface of the duct 211 so as to be discharged from the intake openings 202, which lie below the top end of the intake duct 211.

As best seen in FIG. 2, the intake duct 211 is actually nearer to the starboard side and is disposed in this half part of the cavity 71. The intake opening 202 on the port side is, therefore, coupled to the air compartment 206 through a channel 214. On the other hand, the plenum chamber member 100 is entirely placed within the other half part of the cavity 71. That is, the inlet opening 102 exists in the port side half of the cavity 71. Additionally, the intake openings 202 exist higher than the lower end 218 of the inlet opening 102.

The air introduced through this route is primarily applied for forming air charges for the engine 64, but it is also used for cooling the electrical equipment, i.e., the ECU box 124, power source box 150 and relay box 151, which are disposed forwardly of the engine 64.

In the illustrated embodiment, as seen in FIG. 3, the bottom end 218 of the air intake duct 211 is positioned lower than the bottom end of the air inlet opening 102. The head difference therebetween is designated with the reference H of FIG. 3. Preferably, the bottom end 218 is positioned at the same level as or lower than the bottom end of the plenum chamber member 100.

Because of this configuration, water or moisture 220 that passes through the intake duct 211 will be effectively separated from the air and drops down to the top surface of the lower cowling 70. This arrangement greatly reduces the chance of water or moisture 220 entering the air inlet opening 100. The water dropping on the lower cowling 70 is discharged out thereof through openings, as seen in FIG. 3.

Figure 6:
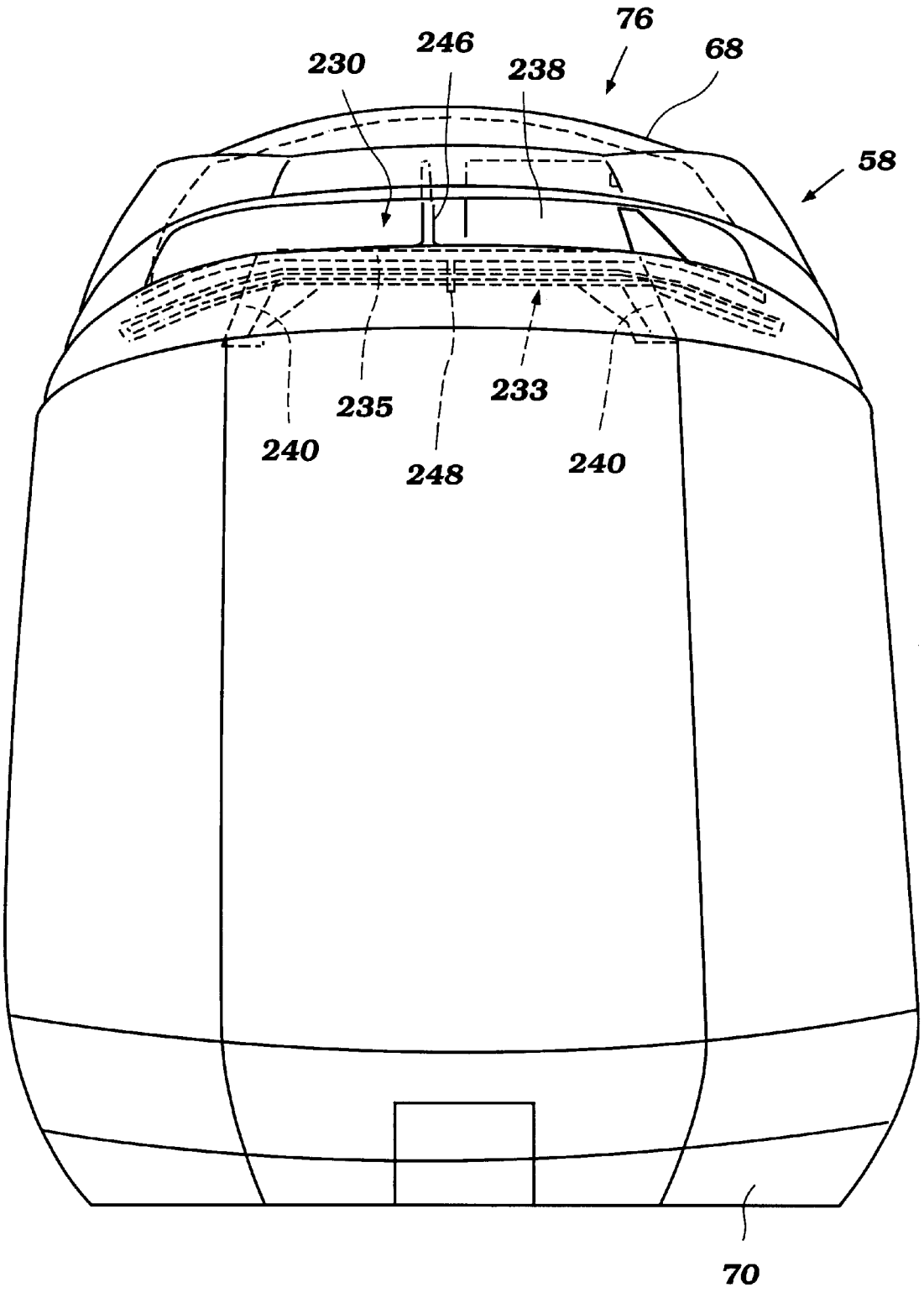
FIG. 6 is a rear elevational view of the cowling assembly. A major part of a rear air intake construction of the cowling assembly is illustrated in phantom.
Figure 7:
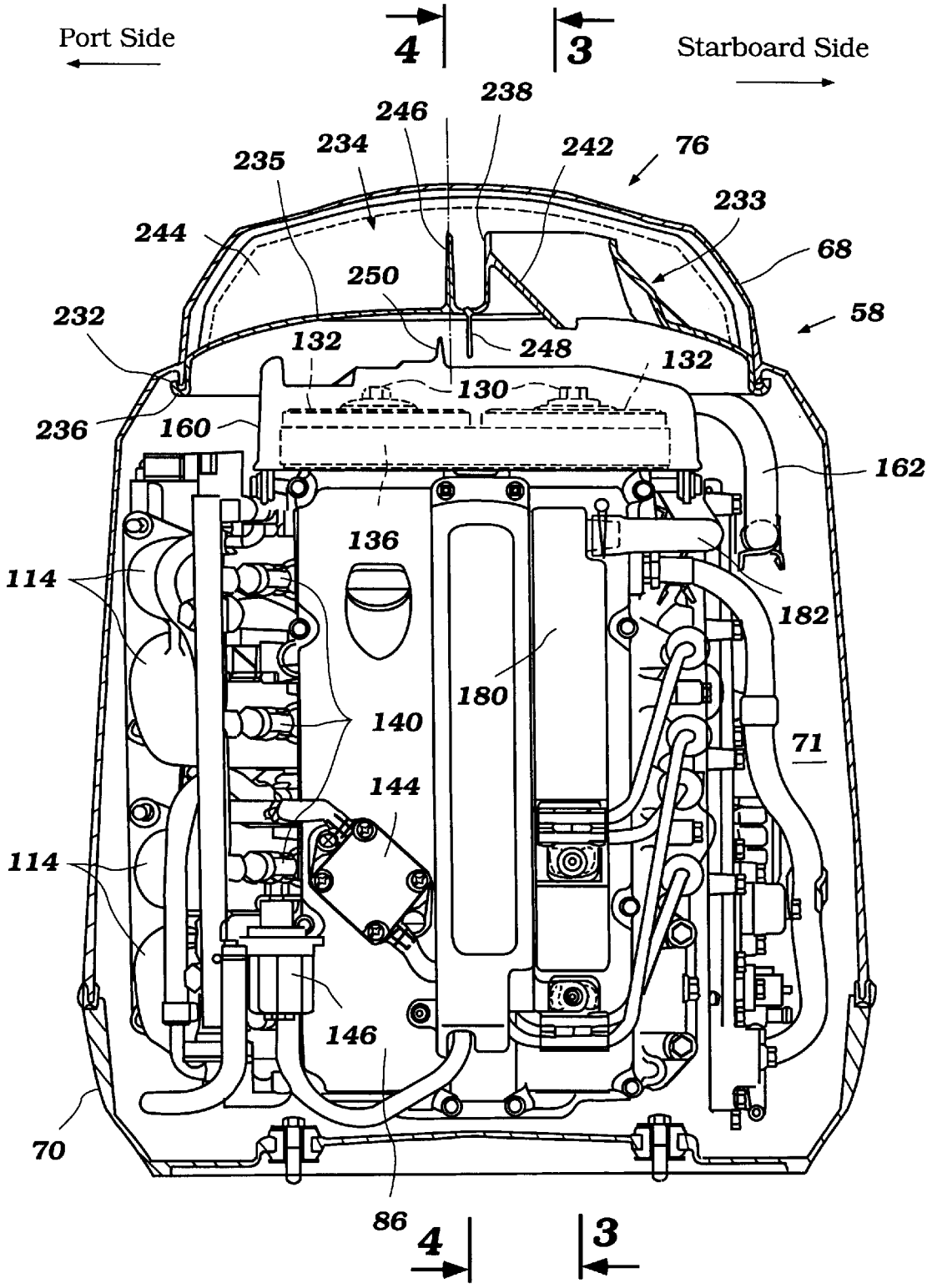
FIG. 7 is a rear elevational view of the power head. The cowling assembly is sectioned along the line 7—7 of FIG. 3 to show the rear air intake construction.
Figure 8:
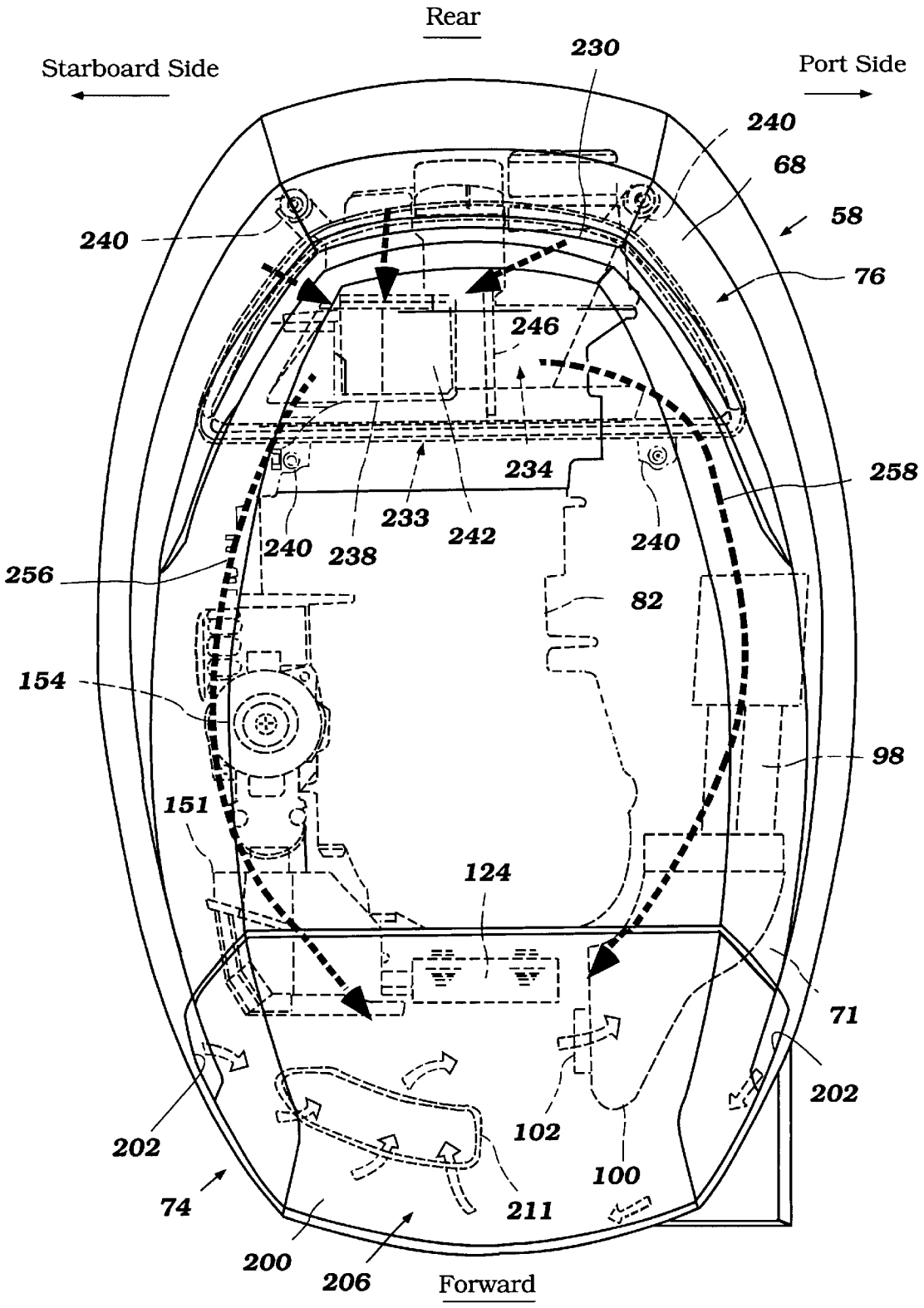
FIG. 8 is a top plan view of the cowling assembly. A front air intake construction, the rear air intake construction and the engine are illustrated in phantom.

Again with reference to FIGS. 1(A) to 5 and additionally with reference to FIGS. 6 to 8, the rear air intake construction 76 will now be described. The top cowling 68 has a rear air intake opening or slit 230 on its rear and uppermost portion. As best seen in FIG. 7, the upper rear portion of the top cowling 68 above the intake slit 230 is configured as a slightly shrunken or concave shape and is provided with a coupling flange 232 that extends generally downwardly as continuing from the outer shell configuration of the shrunken portion of the cowling 68. A rear inner member 233 is attached under the shrunken portion of the cowling 68 to define a rear air compartment or cavity 234 together with the top cowling 68 that acts as a baffle space like the air compartment 206 of the front air intake construction 74. The inner member 233 preferably is made of synthetic resin and includes a main body 235 extending generally horizontally and having a receiving flange 236 around its lower periphery end The receiving flange 236 of the inner member 233 is fitted to the coupling flange 232 via a conventional seal member so that the inner member 233 is sealingly assembled with the top cowling 68. As shown in FIGS. 6 and 8, the inner member 233 has four connecting arms 240 so as to be connected to an inner surface of the cowling 68.

The inner member 233 has a rear air intake duct 238 extending generally upwardly on its starboard side. That is, the intake duct 238 is partial or nearer to this side so as to open to starboard side half of the cavity 71. As seen in FIG. 8, the front air intake duct 238 is positioned in the same side of the cavity 71 while the plenum chamber member 100 is placed in the other side thereof. This arrangement is advantageous because ambient air can travel around the engine 64 before reaching the plenum 96 more than another possible arrangement in which the rear intake duct 238 is positioned in the same half of the cavity 71.

The intake duct 238 preferably is configured to have a rectangular cross-sectional flow area in view of FIG. 8 and has a sloped passage surface or guide 242 that guides air flow toward a starboard side surface of the engine 64. This construction is also advantageous because not only can the air take a circuitous route before reaching the plenum chamber 96, but also any water that may enter the intake duct 238 can be averted from the top portion of the engine 64 as much as possible. In addition, since the guide 242 is directed toward the starboard side that is opposite from the port side of the cavity 71 in which the plenum chamber member 100 exists, the water will be less likely to be carried into the plenum chamber member 100 by the air flow.

The inner member 233 additionally includes a front vertical wall portion 244, an upper baffle 246 and a lower baffle 248. The vertical wall portion 244 closes the air compartment 234 with the body portion 235. The upper baffle 246 extends generally vertically upwardly from the body portion 235 on the center plane C. The lower baffle 248 also extends generally vertically downwardly from the body portion 235. Although the lower baffle 248 is slightly offset from the center plane C toward the starboard side, it still extends in parallel to the center plane C. Both of the baffles 246, 248 are provided primarily for interrupting the flow of water or moisture in the air compartment 234 and the cavity 71 so as to remove the water from the air as soon as possible.

The water or moisture that enters the compartment 234 with the air impinges the upper baffle 246 as well as the surface of the vertical wall portion 244 and the external surface of the intake duct 233. The water then drops down onto the surface of the body portion 235 and flows out through the intake opening 230.

The water or moisture that has not been removed in the air compartment 234 and that enters the cavity 71 will be inhibited by the lower baffle 248 from moving to the port side of the cavity 71 in which the plenum chamber member 100 exists. The water then drops down onto the top surface of the engine 64. The engine 64 also has a projection 250 extending upwardly that blocks the water from flowing toward the port side surface. The water therefore eventually flows toward the starboard side surface away from the port side of the cavity 71.

The air introduced into the cavity 71 through the rear air intake construction 76 is primarily used for cooling the engine 64 and/or engine components.

With reference to FIGS. 1(A) to 8, the entire flow of air will now be described.

In the front air intake construction 74, ambient air is introduced into the air compartment 206 through the front air intake openings 202. As indicated by the white arrows of FIGS. 2, 3, 5 and 8, the air in the compartment 206 passes through the air intake duct 211 and thence flows down toward the top surface of the bottom cowling 70. The air turns upward once inside the cavity 71 and flows toward the air inlet opening 102 of the plenum chamber member 100. Because the plenum chamber member 100 is positioned in the port side of the cavity 71 while the intake duct 211 is positioned in the starboard side thereof, the air must travel around the ECU box 124, power source box 150 and relay box 152 and then enters the plenum chamber 96 through the air inlet opening 102 of the plenum chamber member 100.

During the travel, the air cools the electrical equipment and hence is somewhat warmed up; however, the temperature of the equipment 124, 150, 152 is not too hot. Thus, the air flow is quite usefull for cooling the electrical equipment 124, 150, 152, which are only attached to the engine 64 and have no particular water cooling system. In addition, excessive heat will not accumulate around them even though the cowling assembly 32 surrounds the engine 64. As the result of constant cooling of these electrical components 124, 150, 152, the intake air does not increase in temperature to a degree sufficient to meaningfully influence the charging efficiency.

It should be noted that not only such electrical equipment but also other engine components can be mounted on the front surface of the engine 64 for cooling by the air flow.

As described above, the lower end 218 of the intake duct 211 is positioned lower than the air inlet opening 102 of the plenum chamber 100 with the head difference H. In addition, the water that enters through the duct 211 is heavier than the air. The water, therefore, is sufficiently separated from the air and must drop down onto the top surface of the bottom cowling 70. Thus, the air entering the plenum chamber 96 contains very little water, if any.

In the rear air intake construction 76, ambient air is introduced into the air compartment 234 through the rear air intake opening 230. The upper baffle 246 blocks water particularly coming from the portion of the opening 230 on the port side. As indicated by the thick dotted arrows of FIG. 8, the air in the compartment 234 passes through the air intake duct 238 to the cavity 71. Since the guide slope 242 is provided in the intake duct 238, the air flows downwardly and also toward the side surface of the engine 64 on the starboard side. In addition to the sloped guide 242, the lower baffle 248 and the projection 250 hinder the air in heading to the port side surface of the engine 64. The majority of the air goes through the air inlet opening 102 of the plenum chamber 100 along the surface of the engine 64 on the starboard side as indicated again by the thick dotted arrow 256 of FIG. 8. However, some air can, of course, take another route that exists along the engine surface on the port side as indicated by the thick dotted arrow 258 to the plenum chamber member 100. As a result, the air travels around both sides of the engine 64 and reaches the plenum chamber 96.

During the travel, the air cools portions of the engine components on both of the surfaces during engine operations. However, as described above, the front air intake construction 74 intakes relatively cool air for the plenum chamber 96. Additionally, the quick sweep of the heat by the air flow will not allow accumulation of heat around the engine components in the cowling assembly 32. Thus, the air from the rear air intake construction 76 will not significantly deteriorate the charging efficiency.

As described above, the water that enters the cavity 71 with the air is directed downwardly and toward the engine surface on the starboard side. In addition, the lower baffle 248 and the projection 250 effectively block the water from going to the other side. Thus, the water drops down to the top surface of the bottom cowling 70 on the starboard side and is discharged outside of the cowling assembly 32 through certain openings.

The air passing through both of the intake ducts 211, 238 and then entering the plenum chamber 96 goes to the combustion chambers through the air delivery ducts 98 and will be used for combustion therein.

In the illustrated embodiment, the front air intake openings 202 are provided on both lateral sides of the top cowling 68. This is advantageous because noise generated by the engine 64 will not be directed toward the occupants in the watercraft 40 but rather focused to the sides of the outboard motor.

Also, as noted above, the front and rear air compartments 206, 234 act as baffle spaces. Since both of the air and water can slow down in these compartments 206, 234, intake noise will be efficiently reduced and the water can be rapidly separated from the air.

Figure 9:
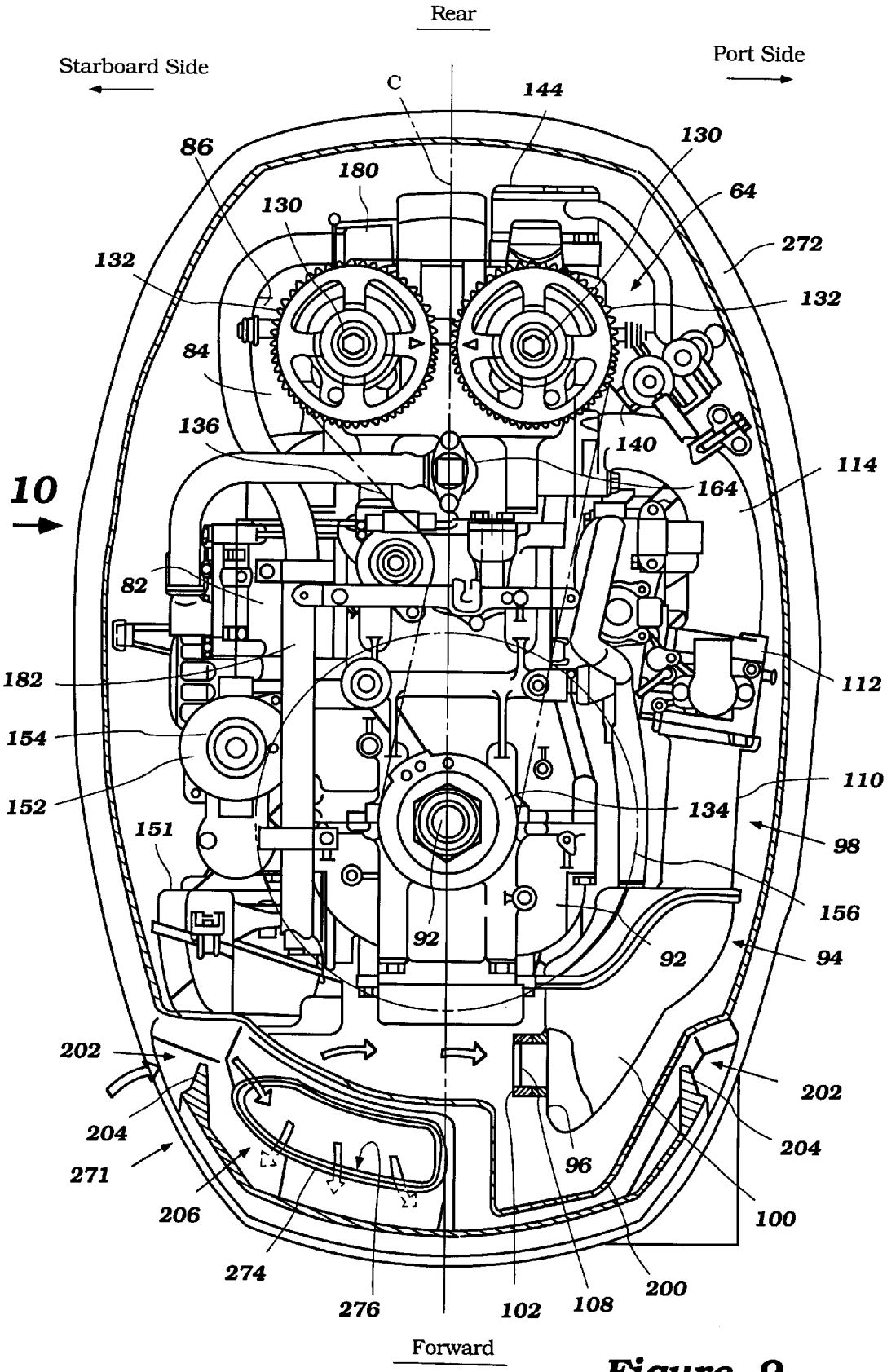
FIG. 9 is a top plan view showing a power head of an outboard motor constructed in accordance with another preferred embodiment of the present invention. A cowling assembly in this arrangement is sectioned along a line similar to line 2—2 of FIG. 1. A plenum chamber member is partially sectioned and an blow-by gas conduit is partially omitted.
Figure 10:
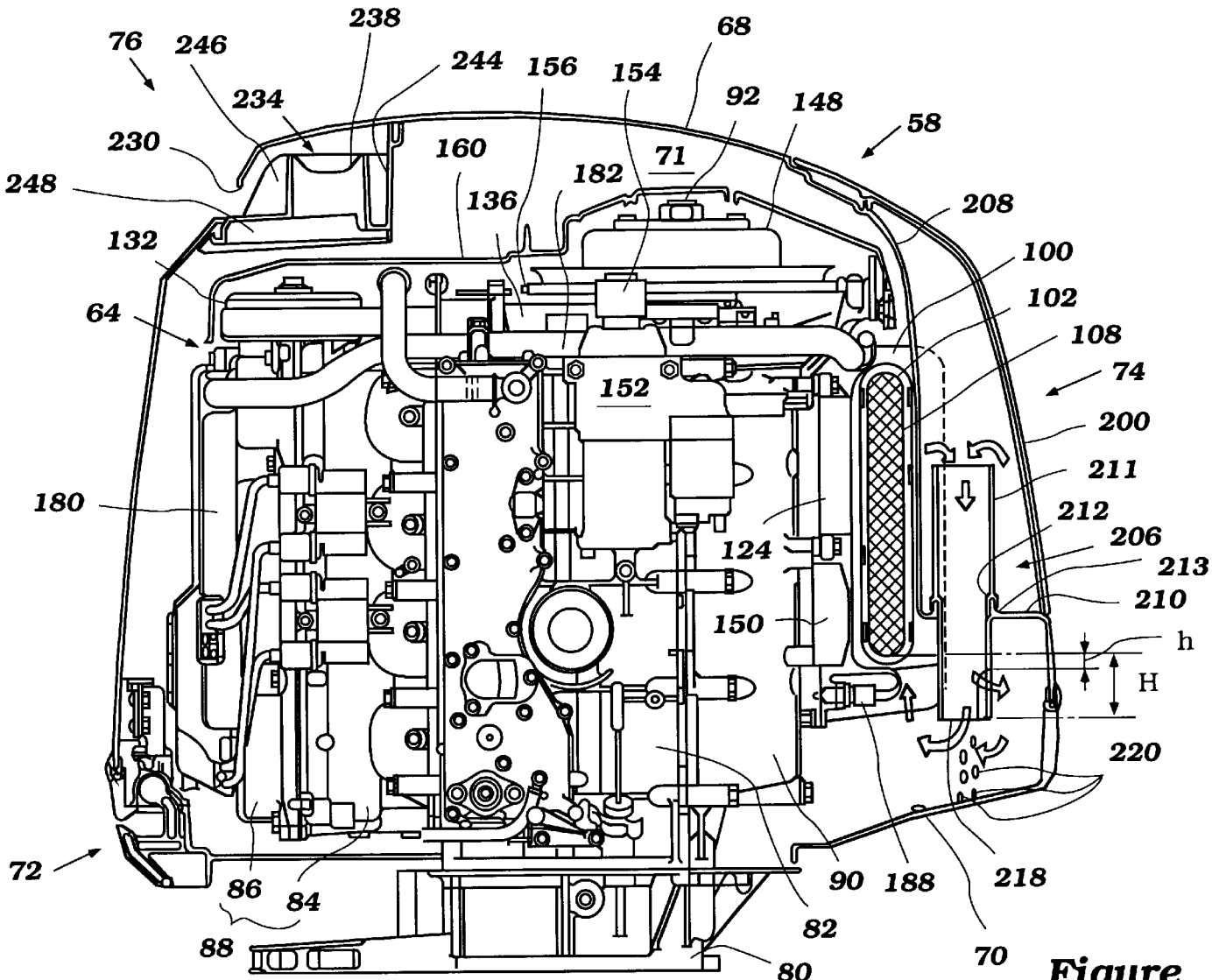
FIG. 10 is a side elevational view of the power head looking in the direction of Arrow 10 of FIG. 9 to show the starboard side construction of the engine. The cowling assembly is sectioned along a line similar to the line 3—3 of FIGS. 2 and 7 associated with the first embodiment.

With reference to FIGS. 9 and 10, another cowling assembly 270 including a front air intake construction 271 configured in accordance with another embodiment of the present invention will now be described. The same members and components that have been shown in FIGS. 1 to 8 and already described will be assigned with the same reference numerals and will not be described again unless particular descriptions are necessary.

A top cowling 272 in this arrangement employs an air intake duct 274, which has a cutout 276, replaces the intake duct 211. The cutout 276 does not face the air inlet opening 102 but faces forwardly in the illustrated embodiment. Also, the cutout 276 exists below the lower end of the inlet opening 102 with the head difference "h". Due to the cutout 276, the air and water passing down through the duct 211 goes downwardly and forwardly. Thus, the chances that the water can enter the plenum chamber 96 will be further reduced.

Figure 11:
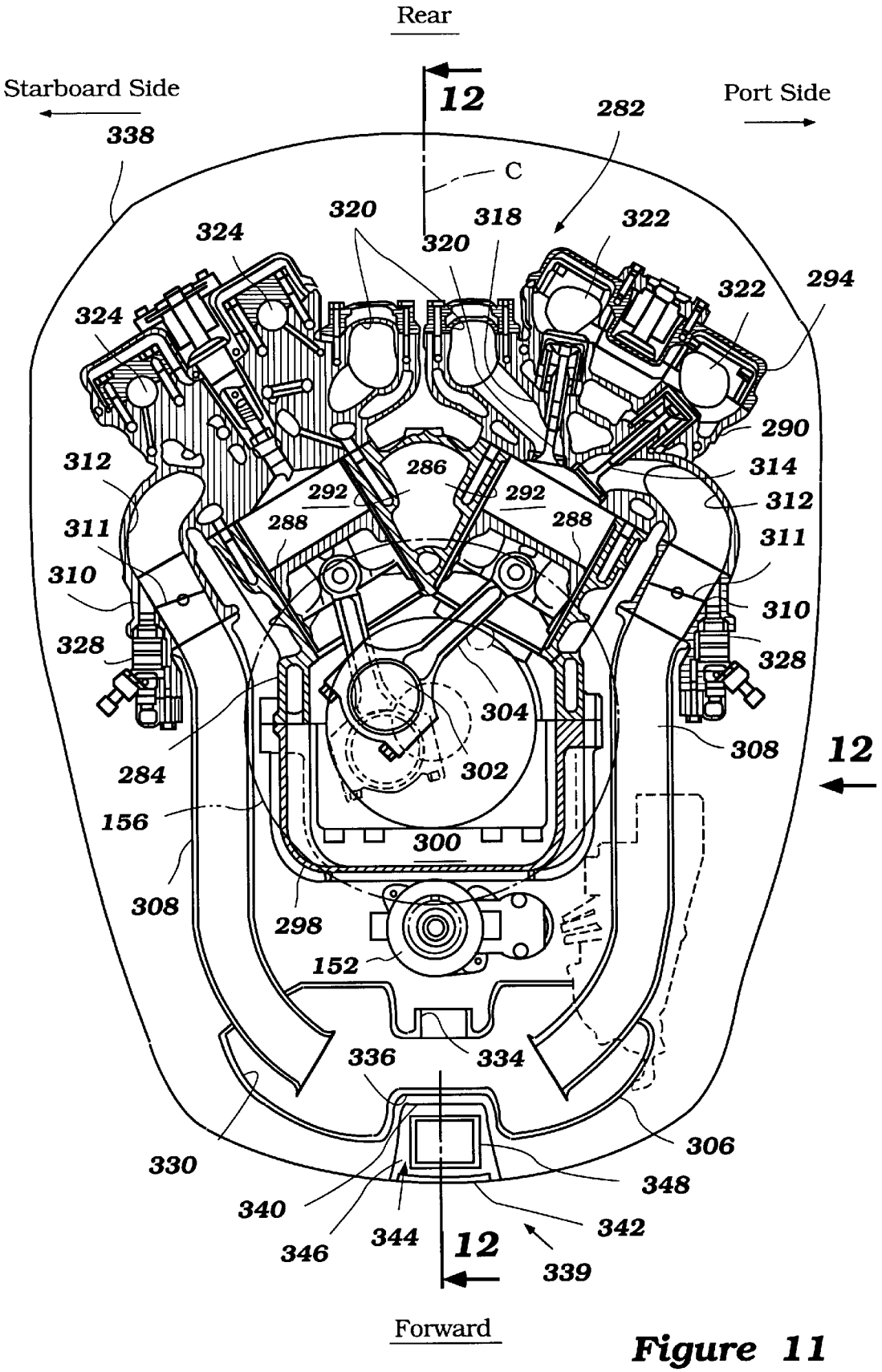
FIG. 11 is a top plan view showing a power head of an outboard motor constructed in accordance with an additional embodiment of the present cowling assembly. The power head is schematically illustrated and the engine including an air induction device in this arrangement is wholly sectioned.
Figure 12:
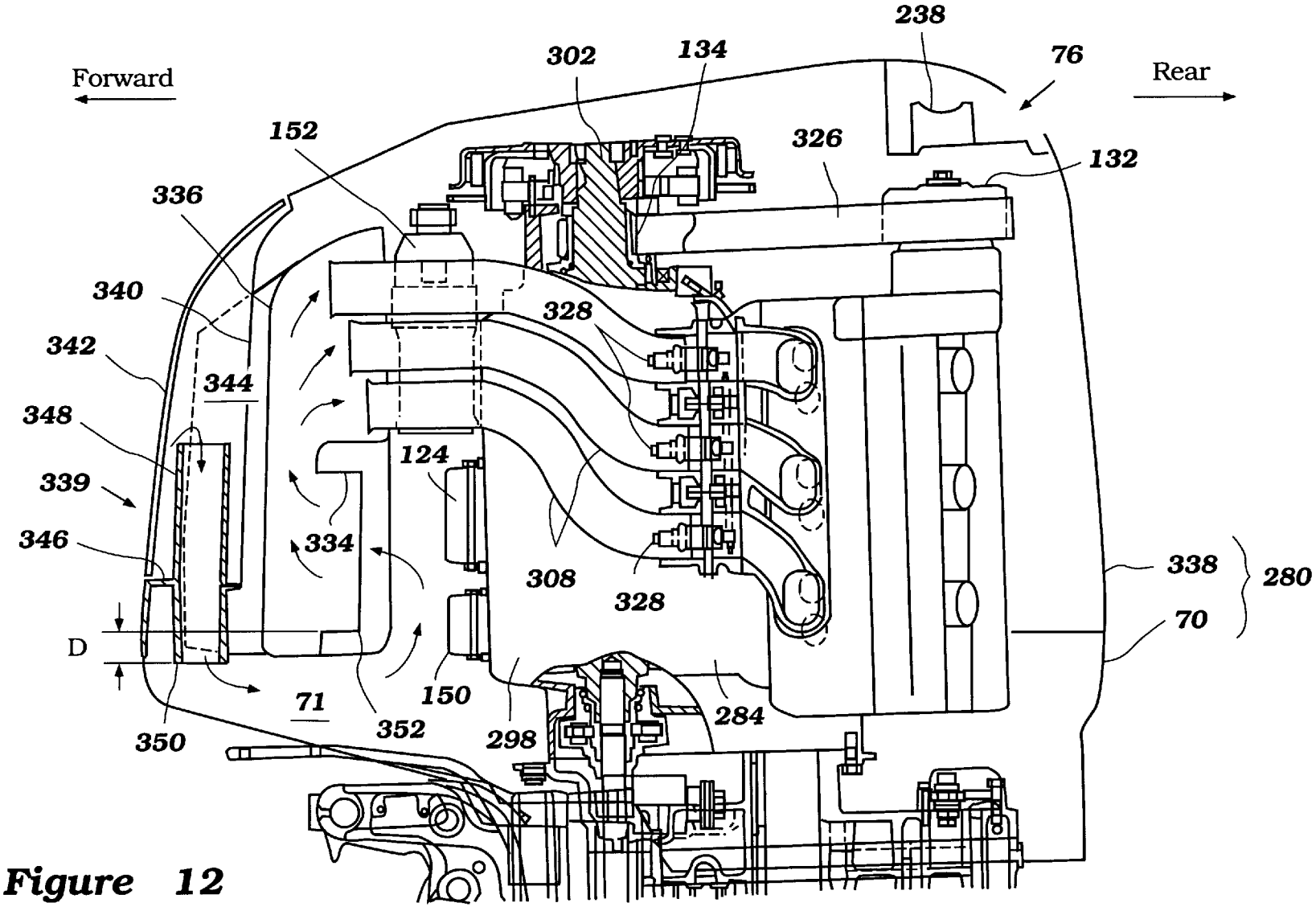
FIG. 12 is a side elevational view of the power head looking in the direction of Arrow 12 to show the starboard side construction of the engine. The cowling assembly is sectioned along the line 12—12 of FIG. 11. A portion of an engine including an air induction device is partially sectioned.

With reference to FIGS. 11 and 12, a further cowling assembly 280 configured in accordance with an additional embodiment of the present invention will be described. Like the previous embodiment, members and components that have been described will be assigned the same reference numerals and not be described again unless particular descriptions are necessary.

An engine 282 employed in this embodiment is a V6 (V configuration six cylinder) type and operates on a four-stroke combustion principle. The engine 282 has a cylinder body 284 that is formed with a pair of cylinder banks. Each of these banks defines three cylinder bores 286 generally horizontally extending and spaced generally vertically with each other. A piston 288 can reciprocate in each cylinder bore 286. A cylinder head member 290 is affixed to one end of the cylinder body 284 and defines six combustion chambers 292 with the pistons 288 and the cylinder bores 286. A cylinder head cover member 294 is affixed to cover the cylinder head member 290.

The other end of the cylinder body 284 is closed with a crankcase member 298 defining a crankcase chamber 300 therein with the cylinder bores 286. A crankshaft 302 extends generally vertically through the crankcase chamber 300. The crankshaft 302 is pivotally connected with the pistons 288 by connecting rods 304 and rotates with the reciprocal movement of the pistons 288.

An air induction system is arranged to supply air charges to the combustion chambers 292 and comprises a plenum chamber member 306, air delivery conduits 308, throttle bodies 310 and intake ports 312. The throttle bodies 310 have throttle valves 311 to measure an amount of the air that pass through the induction system to the combustion chambers 292. The intake ports 132 are formed in the cylinder head member 290 and opened or closed by intake valves 314. When the intake valves 314 are opened, the air delivery conduits 308 communicate with the combustion chambers 292 through the intake ports 312. The plenum chamber member 306 will be described shortly.

An exhaust system is arranged to discharge the burnt charge or exhaust gases from the combustion chambers 292 and comprises exhaust ports 318, exhaust manifold 320 and exhaust conduits. The exhaust ports 318 are formed in the cylinder head member 290 and opened closed by exhaust valves 320. When the exhaust valves 320 are opened, the combustion chambers 292 communicate with the exhaust manifolds 320 through the exhaust ports 318. The exhaust conduits are provided in the driveshaft housing 60 and the lower unit 62 to lead the exhaust gases to the body of water surrounding the outboard motor 30 through the propeller hub.

Cam lobes 322 of camshafts 324 activate the intake and exhaust valves 134, 320. The camshafts 324 are journaled between the cylinder head member 290 and the cylinder head cover member 294 and driven by the crankshaft 302 by a timing belt 326.

A fuel injection system is arranged to supply fuel to the combustion chambers 292. Fuel injectors 328 are mounted on the throttle bodies 310 so that their injector nozzles are directed to the intake ports 312.

The plenum chamber member 306 is positioned in front of the crankcase member 298 and defines a plenum chamber 330 therein. The air delivery conduits 308 extends from the plenum chamber 330 and generally horizontally along both sides of the cylinder body 284. The plenum chamber member 306 has an air inlet opening 334 extending rearwardly from a center portion of the plenum chamber member 306. That is, an axis of the inlet opening 334 extends generally along the center plane C that has been described with the first embodiment.

The plenum chamber member 306 has a recess 336 on the opposite side of the air inlet opening 334, i.e., on its forward surface. Meanwhile, the cowling assembly 280 comprises a top cowling 338 and a bottom cowling 70, which is completely the same as the bottom cowling 70 in the previous embodiments. The top cowling 338 has a front air intake construction 339 that is generally defined in the recess 336.

The top cowling 338 has also a recess 340 that fits along in the recess 336. Both axes of the recesses 336, 340 extend on the center plane C. A front cover 342 is provided to define an air compartment 344 with the recess 340. A bottom portion 346 of the recess 340 extends generally horizontally and an air intake duct 348 pass through the bottom portion 346 to connect the air compartment 344 to the cavity 71. The intake duct 348 and the inlet opening 334 of the plenum chamber member 306 align along the center plane C.

The lower end 350 of the intake duct 348 is positioned lower than the lower end 352 of the inlet opening 334. The head difference between both of the lower ends 350, 352 is indicated by the reference mark D.

Although not shown, air intake openings are formed between the top cowling 338 and the front cover 342 as described with the first embodiment. Ambient air is introduced through the openings. The air passes through the intake duct 348 and then goes to the air delivery conduits 308 as indicated by the arrows of FIG. 12. Water that enters with the air by passing through the intake duct 348 is separated from the air and drops down to the top surface of the bottom cowling 70. Since the head difference D is set between the lower end 350 of the intake duct 348 and the lower end 352 of the air inlet opening 334 like in the first embodiment, the water will not enter the inlet opening 334.

The cowling assembly 280 has also the rear air intake construction 76 that is completely same as the rear air intake construction 76 in the other embodiments. The other constructions including components and members in this embodiment is generally the same as the constructions, components and members already described with the first and second embodiments.

It should be noted that the front air intake construction may be formed like the rear air intake construction and vice versa. That is, an inner member or shell member can be provided separately from the top cowling and affixed onto an inner surface of the top cowling to define an air compartment with the top cowling. This is essentially the same as the rear air intake construction. Likewise, the rear air intake construction can be formed in the same way as in arranging the front air intake construction. In this alternative construction, the intake openings are formed only with and on the cowling member.

Also, the plenum chamber member may have any configurations and can be disposed in any arrangements. Further, its air inlet opening also can be placed in any positions of the plenum chamber member.

Of course, the foregoing description is that of preferred embodiments of the invention, and various changes and modifications may be made without departing from the spirit and scope of the invention, as defined by the appended claims.

What is claimed is:

1. An outboard motor comprising an internal combustion engine including an air induction device, the air induction device defining an air inlet opening, and a cowling assembly including a cowling member defining a generally closed first cavity that contains the engine, an air intake duct introducing ambient air into the first cavity, the air intake duct arranged adjacent to the air inlet opening, the intake duct opening into the first cavity at a location generally lower than a lower end of the air inlet opening of the air induction device, and a shell member defining a second cavity together with the cowling member, the intake duct coupling the second cavity with the first cavity.

2. An outboard motor as set forth in claim 1, wherein the cowling member defines a step-like portion, and the intake duct is disposed at the step-like portion.

3. An outboard motor as set forth in claim 2, wherein the intake duct includes an upper portion extending generally above the step-like portion and a lower portion extending below the step-like portion.

4. An outboard motor as set forth in claim 3, wherein the lower portion has a cutout that does not face to the inlet opening.

5. An outboard motor as set forth in claim 2, wherein the intake duct is provided separately from the step-like portion and is coupled thereto.

6. An outboard motor as set forth in claim 2, wherein an inner member defining the step-like portion is provided separately from the cowling member and is affixed onto an inner surface of the cowling member to define a second cavity therebetween.

7. An outboard motor as set forth in claim 6, wherein the cowling member defines an air intake opening through which ambient air is introduced into the second cavity.

8. An outboard motor as set forth in claim 1, wherein the shell member defines at least one air intake opening through which ambient air is introduced into the second cavity.

9. An outboard motor as set forth in claim 8, wherein the air intake opening is defined between the shell member and the cowling member.

10. An outboard motor as set forth in claim 9, wherein the shell member has at least one projection extending toward the cowling member.

11. An outboard motor as set forth in claim 8, wherein the air intake opening is defined within the shell member.

12. An outboard motor as set forth in claim 8, wherein the intake opening exists higher than the lower end of the inlet opening.

13. An outboard motor as set forth in claim 8, wherein the shell member defines the air intake opening on its side surface.

14. An outboard motor as set forth in claim 1, wherein the shell member defines the second cavity with a front portion of the cowling member.

15. An outboard motor as set forth in claim 14, wherein the shell member defines an air intake opening on its side surface through which ambient air is introduced into the second cavity.

16. An outboard motor as set forth in claim 14, wherein the cowling member defines a second air intake opening on its rear surface.

17. An outboard motor as set forth in claim 1, wherein the inlet opening is provided on a plenum chamber.

18. An outboard motor comprising an internal combustion engine including an air induction device, the air induction device defining an air inlet opening, and a cowling assembly including a cowling member defining a generally closed cavity that contains the engine, and an air intake duct introducing ambient air into the cavity, the air intake duct arranged adjacent to the air inlet opening, the intake duct opening into the cavity at a location generally lower than a lower end of the air inlet opening of the air induction device, the inlet opening extending generally vertically, and the intake duct extending generally parallelly to the inlet opening.

19. An outboard motor comprising an internal combustion engine including an air induction device, the air induction device defining an air inlet opening, and a cowling assembly including a cowling member defining a generally closed cavity that contains the engine, and an air intake duct introducing ambient air into the cavity, the air intake duct arranged adjacent to the air inlet opening, the intake duct opening into the cavity at a location generally lower than a lower end of the air inlet opening of the air induction device, the inlet opening existing generally within one half of the cavity defined by a center plane extending generally vertically, and the intake duct existing generally within the other half of the cavity.

20. An outboard motor as set forth in claim 19, wherein the inlet opening faces toward the opposite half of the cavity in which the intake duct is disposed.

21. An outboard motor as set forth in claim 20, wherein the inlet opening has an axis extending generally normal to the center plane.

22. An outboard motor comprising an internal combustion engine including an air induction device, the air induction device defining an air inlet opening, and a cowling assembly including a first cowling member defining a generally closed cavity that contains the engine, an air intake duct introducing ambient air into the cavity, the air intake duct arranged adjacent to the air inlet opening, the intake duct opening into the cavity at a location generally lower than a lower end of the air inlet opening of the air induction device, and a second cowling member disposed lower than the first cowling member, both of the first and second cowling members being coupled together, and the lower end of the intake duct being positioned lower than an interface between the first and second cowling members adjacent to the intake duct.

23. An outboard motor comprising an internal combustion engine including an air induction device, the air induction device including an air inlet opening, and a cowling assembly including a cowling member defining a generally closed cavity that contains the engine, the cowling member having at least one front air intake opening formed on a side surface of a front portion of the cowling member and a rear air intake opening formed on a rear surface of a rear portion of the cowling member, and ambient air being introduced into the cavity through both of the front and rear air intake openings and drawn into the inlet opening.

24. An outboard motor as set forth in claim 23, wherein the cowling member has a pair of the front openings, and each front opening is located on each side surface of the front portion of the cowling member.

25. An outboard motor comprising an internal combustion engine including an air induction device, the air induction device defining an air inlet opening, and a cowling assembly including a cowling member defining a generally closed first cavity that contains the engine, the cowling member having at least one front air intake opening formed on a side surface of a front portion of the cowling member and a rear air intake opening formed on a rear surface of a rear portion of the cowling member, a shell member defining a second cavity together with the front portion of the cowling member, ambient air being introduced through the front air intake opening into the second cavity, and an air intake duct adjoining the air inlet opening and coupling the second cavity with the first cavity, the intake duct having a lower opening positioned generally lower than a lower end of the air inlet opening.

26. An outboard motor comprising an internal combustion engine including an air induction device, the air induction device defining an air inlet opening, and a cowling assembly including a cowling member defining a generally closed first cavity that contains the engine, the cowling member having at least one front air intake opening formed on a side surface of a front portion of the cowling member and a rear air intake opening formed on a rear surface of a rear portion of the cowling member, a shell member defining a second cavity together with the rear portion of the cowling member, ambient air being introduced through the rear air intake opening into the second cavity, an air intake duct coupling the second cavity with the first cavity, and a baffle positioned adjacent to an inlet of the air intake duct to inhibit water from entering the intake duct.

27. An outboard motor comprising an internal combustion engine including an air induction device, the air induction device defining an air inlet opening, and a cowling assembly including a cowling member defining a generally closed first cavity that contains the engine, the cowling member having at least one front air intake opening formed on a side surface of its front portion and a rear air intake opening formed on a rear surface of a rear end portion, a shell member defining a second cavity together with the rear end portion of the cowling member, ambient air being introduced through the rear air intake opening into the second cavity, and an air intake duct coupling the second cavity with the first cavity, the air intake duct being disposed above at least a portion of the engine, and the air intake duct having a guide directing the air toward one side of the engine.

28. An outboard motor as set forth in claim 27, wherein the inlet opening exists generally within one half of the cavity defined by a center plane extending generally vertically, and the guide leads the air toward the other half of the cavity.

29. An outboard motor comprising an internal combustion engine including an air induction device, the air induction device defining an air inlet opening, and a cowling assembly including a cowling member defining a generally closed cavity that contains the engine, the cowling member having at least one front air intake opening formed on a side surface of a front portion of the cowling member and a rear air intake opening formed on a rear surface of a rear portion of the cowling member, and a front air intake duct adjacent to the front air intake opening, ambient air being introduced through the front air intake duct into the cavity, a rear air intake duct adjacent to the rear air intake opening, the ambient air being introduced also through the rear air intake duct into the cavity, the inlet opening existing generally within one half of the cavity defined by a center plane extending generally vertically, and the front and rear intake ducts both existing generally within the other half of the cavity.

30. An outboard motor comprising an internal combustion engine including an air induction device, the air induction device defining an air inlet opening, and a cowling assembly including a cowling member defining a generally closed first cavity that contains the engine, the cowling member having at least one front air intake opening formed on a side surface of a front portion of the cowling member and a rear air intake opening formed on a rear surface of a rear portion of the cowling member, a shell member defining a second cavity together with the rear portion of the cowling member, ambient air is introduced through the air intake opening into the second cavity, an air intake duct coupling the second cavity with the first cavity, and a baffle positioned adjacent to an outlet of the air intake duct.

31. An outboard motor comprising an internal combustion engine including an air induction device, the air induction device defining an air inlet opening, and a cowling assembly including a cowling member defining a generally closed cavity that contains the engine, and an air intake duct introducing ambient air into the cavity, the inlet opening extending generally vertically, and the intake duct extending generally in parallel to the inlet opening.

32. An outboard motor comprising an internal combustion engine including an air induction device, the air induction device defining an air inlet opening, and a cowling assembly including a cowling member defining a generally closed cavity that contains the engine, and an air intake duct introducing ambient air into the cavity, the inlet opening existing generally within one half of the cavity defined by a center plane extending generally vertically, and the intake duct existing generally within the other half of the cavity.

33. An outboard motor as set forth in claim 32, wherein the inlet opening faces toward the opposite half of the cavity in which the intake duct is disposed.

34. An outboard motor comprising an internal combustion engine including an air induction device, the air induction device defining an air inlet opening, and a cowling assembly including a cowling member defining a first cavity that contains the engine, the cowling member having an air intake opening, a shell member defining a second cavity together with the cowling member, ambient air being introduced into the second cavity through the air intake opening, an air intake duct coupling the second cavity with the first cavity, and a baffle positioned adjacent to an inlet of the air intake duct to inhibit water from entering the intake duct.

35. An outboard motor comprising an internal combustion engine including an air induction device, the air induction device defining an air inlet opening, and a cowling assembly including a cowling member defining a first cavity that contains the engine, the cowling member having an air intake opening, a shell member defining a second cavity together with the cowling member, ambient air being introduced through the air intake opening into the second cavity, and an air intake duct coupling the second cavity with the first cavity, the air intake duct being disposed above at least a portion of the engine, and the air intake duct having a guide directing the air toward one side of the engine.

36. An outboard motor as set forth in claim 35, wherein the inlet opening exists generally within one half of the cavity defined by a center plane extending generally vertically, and the guideleads the air toward the other half of the cavity.

37. An outboard motor comprising an internal combustion engine including an air induction device, the air induction device defining an air inlet opening, and a cowling assembly including a cowling member defining a first cavity that contains the engine, the cowling member having an air intake opening, a shell member defining a second cavity together with the cowling member, ambient air being introduced into the second cavity through the air intake opening, an air intake duct coupling the second cavity with the first cavity, and a baffle positioned adjacent to an outlet of the air intake duct.

* * * * *